US005433346A

United States Patent [19]

Howe

[11] Patent Number: 5,433,346

[45] Date of Patent: Jul. 18, 1995

[54] DISPENSING CONTAINER FOR MINIMIZING LIQUID CONTENT'S EXPOSURE TO AIR

[76] Inventor: David J. Howe, 27 A Country Club La., Milford, Mass. 01757

[21] Appl. No.: 183,044

[22] Filed: Jan. 18, 1994

[51] Int. Cl.[6] ..... B65D 35/24

[52] U.S. Cl. ..... 222/94; 222/105; 222/130; 222/481.5; 222/484; 222/555

[58] Field of Search ..... 222/94, 105, 130, 481, 222/481.5, 482, 484, 555

[56] References Cited

U.S. PATENT DOCUMENTS

| | | | |
|---|---|---|---|
| 3,123,254 | 3/1964 | Rabby et al. | 222/105 |
| 4,256,150 | 3/1981 | Mockesch | 141/5 |
| 4,264,019 | 4/1981 | Roberts et al. | 222/95 |
| 4,623,075 | 11/1986 | Riley | 222/95 |
| 4,699,299 | 10/1987 | Gach | 222/482 X |
| 4,756,450 | 7/1988 | Negaty-Hindi et al. | 222/95 |
| 4,832,219 | 5/1989 | Nyez | 222/482 X |
| 4,854,483 | 8/1989 | Haggert | 222/95 |
| 4,869,402 | 9/1989 | Ash, Jr. | 222/209 |
| 4,881,666 | 11/1989 | Tullman et al. | 222/386 |
| 4,892,230 | 1/1990 | Lynn, Jr. | 222/105 |
| 4,907,724 | 3/1990 | Wing, Jr. | 222/105 |
| 4,921,135 | 5/1990 | Pleet | 222/82 |
| 4,984,713 | 1/1991 | Chambers et al. | 222/105 |
| 5,115,943 | 5/1992 | Coleman | 222/94 |
| 5,135,137 | 8/1992 | Rudick | 222/1 |
| 5,139,169 | 8/1992 | Boyer | 222/103 |
| 5,147,071 | 9/1992 | Rutter et al. | 222/92 |

FOREIGN PATENT DOCUMENTS

| | | | |
|---|---|---|---|
| 181504 | 12/1935 | Switzerland | 222/481 |
| 2220408 | 1/1990 | United Kingdom | 222/94 |

*Primary Examiner*—Andres Kashnikow
*Assistant Examiner*—Joseph A. Kaufman
*Attorney, Agent, or Firm*—Haverstock, Garrett And Roberts

[57] ABSTRACT

A container and a valve located thereon from which liquid substances can be dispensed wherein the container has inner and outer wall portions, one within the other, and a liquid substance positioned within one of the wall portions but not within the other wall portion. The valve has a first port communicating with the space within the one wall portion and a second port communicating with the space within the other wall portion, and a valve operator member movable between a first position simultaneously closing the first and second ports and a second position simultaneously opening the first and second ports. The valve directs incoming replacement air into one portion of the container as liquid is dispensed out from the other portion.

7 Claims, 4 Drawing Sheets

DISPENSING CONTAINER FOR MINIMIZING LIQUID CONTENT'S EXPOSURE TO AIR

FIELD OF THE INVENTION

The present invention relates to dispensing containers, and more particularly, to multi-wall devices for maintaining liquids separate from the atmosphere.

BACKGROUND OF THE INVENTION

Carbonated beverages, including soft drinks, sparkling waters, alcoholic beverages and the like, tend to lose carbonation and "go flat" upon prolonged or repeated exposure to the environment. Such exposures commonly can occur when a bottle is left uncapped or through repeated opening and closing of a container. Carbonation resulting from carbon dioxide gas dissolved in the beverage can escape from the beverage into a head space portion of a sealed container above the beverage. When a conventional container is opened, the pressurized gas in the head space escapes from the container, resulting in the loss of that amount of carbon dioxide. By itself the repeated opening of a container results in an undesirable loss of carbonation from the beverage. In addition, when beverage is subsequently dispensed from the opened container, a larger head space volume forms into which additional carbon dioxide can diffuse after the container is closed or resealed. Thus, repeated opening and dispensing of carbonated beverage from a conventional container results in an even greater and more rapid loss of carbonation. The loss of carbonation through container opening and closing is a prevalent design limitation with larger multiple serving sized containers.

Several containers have employed differing means of maintaining a sufficient amount of carbonation in beverages, such as including means for minimizing head space formation. Specifically, Chambers et al. U.S. Pat. No. 4,984,713 discloses a beverage container having an inner portion within an outer wall portion, an air admitting one-way check valve and a separate dispensing tap located on opposite portions of the container. The check valve automatically admits replacement air into a space between the inner portion and the outer wall as beverage is dispensed therefrom. Tullman et al. U.S. Pat. No. 4,881,666 discloses a bottle-like container with substantially rigid walls wherein a one-way valve is fixed in a base opposite an orifice used for pouring the beverage. The one-way valve communicates with a collapsible, substantially gas impermeable bag which is inflatable with replacement air to eventually fully occupy the container volume. The container disclosed in Lynn, Jr. U.S. Pat. No. 4,892,230 includes a rigid outer bottle-like container having a neck and mouth, and an inner collapsible pouch within the bottle for containing the beverage. The neck of the bottle contains a passageway for admitting air into an internal air space between the pouch and the outer wall when a separate cap is removed and part of the beverage is dispensed. When the cap is reinstalled, it seals the passageway and prevents the ambient atmosphere and the air trapped in the internal air space from backfilling into the beverage containing pouch. The air trapped in the internal air space is compressed between the rigid bottle wall and the expanding pouch by carbonation escaping from the remaining beverage. This compression acts to prevent total expansion of the pouch and reduces the amount of carbon dioxide that escapes into the head space.

Other containers have included external means of pressurizing the beverage to reduce the loss of carbonation. Riley U.S. Pat. No. 4,623,075 discloses a container wherein a flexible bag containing a carbonated beverage is located within a substantially cylindrical tube formed of rigid or elastic material. The tube transmits pressure to the flexible bag to counteract the expansion due to carbon dioxide out gassing from the carbonated beverage. Similarly, Haggart U.S. Pat. No. 4,854,483 discloses a container which includes a diaphragm of resilient material to continually exert pressure on a beverage contained in a separate bag until the bag is emptied. Negaty-Hindi et al U.S. Pat. No. 4,756,450 discloses a container which incorporates either elastic material, ratchet means or spring means to exert external force on a flexible bag containing a beverage as the liquid is dispensed from the container.

These previously disclosed devices differ significantly from that presently disclosed. The present device is adaptable for containing and dispensing liquids or beverages without separate air venting and liquid dispensing devices or external pressurizing means. Instead, the present invention resides in a multi-wall device for containing liquids and beverages, where the beverage is contained substantially separate from the incoming replacement air. The present container importantly includes a single dual orifice valve which directs replacement air to back fill a container portion separate from the liquid containing portion to minimize undesirable contact between ambient air and the liquid contained within.

SUMMARY OF THE INVENTION

The present improved container includes a dual orifice valve which directs the introduction of replacement air into a chamber of the container as the liquid or carbonated beverage is dispensed from a separate other chamber portion thereby reducing the contact of replacement air with the carbonated beverage remaining therein. Reduced contact between a carbonated beverage and replacement air beneficially affects the loss of carbon dioxide into a head space portion of the container normally formed as a beverage is dispensed from conventional containers. The present invention may be adapted for use in multiple serving containers for carbonated beverages, including those with capacities approaching if not exceeding approximately two gallons, although the containers can be formed in other sizes as well.

The key to this invention resides in the combination of a single dual orifice valve and other container chamber portions which maintain the liquid and replacement air in a separated condition as the liquid or beverage is dispense thereform. The dual orifice valve located on an external outer container wall surface simultaneously dispenses the contained beverage from one container chamber and directs the incoming replacement air into another container chamber separate from the beverage-containing chamber. Specifically, in one embodiment, the replacement air can vent into an inflatable bag-like portion located within a substantially separate outer wall portion containing the beverage. The outer container wall also adds stability to the container overall and is capable of supporting beverage advertising and other indicia. Importantly, as beverage is dispensed from one container portion through one orifice of the dual orifice valve, pressure equalizing incoming replacement air feeds through the same valve's second orifice into the flexible bag-like portion. Ambient air does not back diffuse through the beverage-dispensing valve orifice when the beverage is dispensed therethrough so that the contact of replacement air with the beverage remaining in the container is kept to a minimum. As the beverage is dispensed, the wall of the inner portion inflates with the increasing air volume, preventing the formation of a head space into which dissolved carbon dioxide would normally diffuse. Thus the carbon dioxide remains in the beverage and maintains the desired "fizz" for a much longer period of time.

Alternatively, other orientations of the beverage containing portion and the air containing portion may be incorporated. The carbonated beverage can be contained in a variable shaped, flexible bag-like inner wall portion, substantially independent of the replacement air contained by the outer wall. As the beverage is dispensed through the single dual orifice valve, the wall of the inner portion collapses with the decreasing beverage volume, preventing the formation of a head space into which dissolved carbon dioxide would normally diffuse.

Although the present invention is specifically directed to the conditions commonly associated with carbonated beverage containers, such as those for soft drinks and sparkling waters, it is recognized that the present invention can be adapted for use with other types of carbonated liquids, such as carbonated alcoholic beverages and the like.

OBJECTS OF THE INVENTION

It is therefore a principal object of the present invention to teach the construction and operation of a dispensing container for liquids capable of minimizing the loss of carbonation from a beverage associated with the opening and closing of the container and from dispensing of the beverage.

Another object is to provide a means of separating a beverage from air admitted into a container during the beverage dispensing process.

Another object is to provide a means of preventing the back flow of air through the beverage dispensing nozzle during beverage dispensing.

Still another object is to provide a single means for dispensing a beverage and for directing replacement air into a container portion separate from the remaining beverage.

Another object is to provide a device for maintaining the container in a preferred dispensing position.

Another object is to provide a cost effective method of producing reusable or recyclable carbonated beverage containers.

These and other objects and advantages of the present invention will become apparent to those skilled in the art after considering the following detailed specification in conjunction with the accompanying drawings.

DETAILED DESCRIPTION OF PREFERRED EMBODIMENTS OF THE INVENTION

Figure 1:
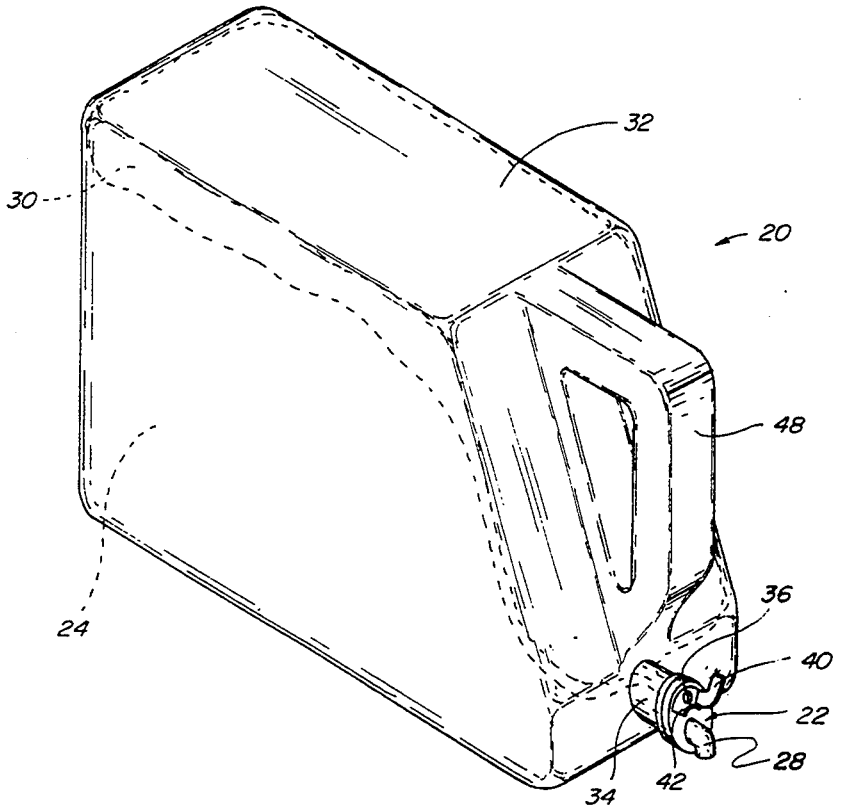
FIG. 1 is a perspective view of one embodiment of the present soft drink container constructed according to the teachings of the present invention and filled with a beverage.
Figure 2:
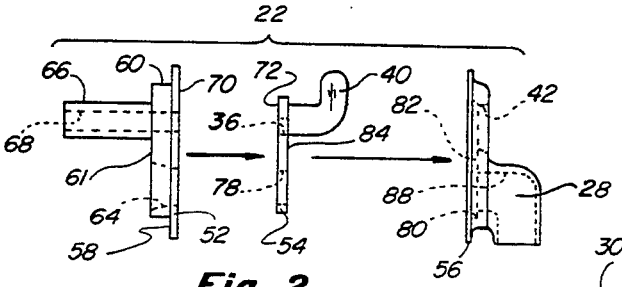
FIG. 2 is an exploded side view of a dual orifice dispensing valve of the present invention.
Figure 4:
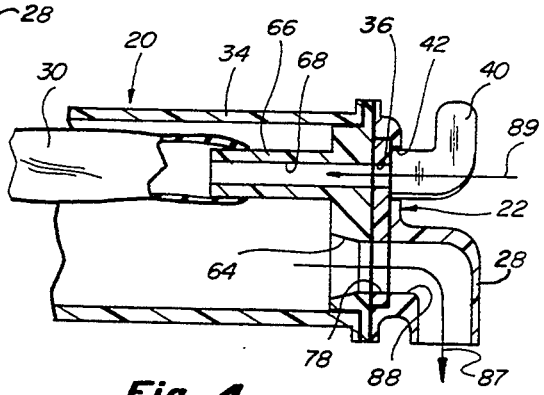
FIG. 4 is a cross-sectional view taken along line 4—4 of FIG. 3.

Referring to the drawings more particularly by reference numbers wherein like numerals refer to like parts, number 20 in FIG. 1 identifies one embodiment of a container such as a carbonated beverage container constructed according to the present invention. The container 20 includes a dual orifice valve 22 as a single means for dispensing a beverage 24 contained therein, such as through valve spout orifice 28, while directing replacement air into an inner inflatable bag-like chamber portion 30. The flexible bag-like inner portion 30 is contained within an outer wall 32 portion which can be relatively rigid and forms the general shape of the container. In this embodiment, the beverage 24 is initially added so as to substantially fill the container 20 between the rigid outer wall 32 and the bag-like portion 30. The valve 22 is preferably sealably inserted into a tube shaped neck container portion 34 positioned on the front facing portion of the container 20. A second valve orifice 36, as further detailed in FIGS. 2 and 4, is a portion of a means for directing incoming replacement air into the inflatable bag-like portion 30. The container embodiment of the present invention generally operates in the following manner. Beverage 24 from one chamber of a filled container 20 is dispensed through spout 28 when a handle protuberance 40 is rotated in the guide opening 42 so as to position the dual orifice valve 22 into an open orientation. Simultaneous with the dispensing of beverage 24, when in the open orientation, a second valve orifice 36 forms a passageway from outside the container 20 through to the inner bag-like portion 30. The replacement air is pulled through orifice 36 and inflates the bag-like portion 30 as the beverage 24 is dispensed. When the valve handle 40 is moved towards the opposite orientation in the guide opening 42 and into a closed position, the orifices and passageways to the beverage and replacement air containing portions are closed and sealed off from each other and from the outside atmosphere so as to prevent leakage and carbonation depleting interaction between the retained replacement air and the beverage 24.

In addition, the container 20 can also include a carrying handle 48 formed or attached to a convenient location, such as a top or front facing portion of the container 20. The outer container wall 32 provides stability to the container overall and is capable of supporting beverage advertising and other indicia. The present embodiment of the invention can be adapted for use in a wide number of applications where reduced exposure of a liquid to the atmosphere is beneficial, such as multiple serving containers for alcoholic or carbonated beverages. Such containers include those with capacities between approximately two and two and one half gallons, although the containers can be formed in other sizes as well. A two gallon container would be significantly larger than that currently commercially available, yet still would be suitable for domestic use.

The exploded view in FIG. 2 of one embodiment of a possible dual orifice valve 22 discloses the valve components including insert 52, rotatable disc 54 and nozzle 56. Insert component 52 is designed so that a back lip face 58 can sealably contact an external surface of the rigid container outer wall (not shown). In addition, insert side wall 60 can contact a rigid wall surface such as a container internal surface and the contacting surfaces can be sealed together. A tubular insert portion 66 extending significantly into a container neck portion when inserted therein can be connected with and sealed to an inner bag-like portion of the container. In this embodiment of a carbonated beverage container, the dual orifice valve 22 is designed to be adapted to a container where the replacement air inflates a flexible bag portion, such as bag 30. The beverage dispensing opening or port 64 of insert 52 can have a greater diameter on the surface 61 facing towards the contained beverage than on the face 70 in contact with the rotatable plate or disc 54, foraging a slightly conical opening therein. The air inlet opening or port 68 of the insert, extending the length of tubular portion 66, is preferably the same diameter throughout. In general, the openings designed to accommodate beverage movement, such as opening 64, are preferably larger than those designed to accommodate incoming replacement air, such as opening 68. The insert face 70 is preferably an approximately smooth surface that contacts a similarly smooth face 72 of the rotatable disc 54. The valve handle 40 protruding forward and outward from the valve, can be formed integral with or subsequently attached to the substantially flat face portion 84 of rotatable disc 54. Nozzle component 56 slips over and directs the rotatable disc 54 into a recess 80 so that when the valve 22 is properly assembled, the rotatable disc 54 is effectively sandwiched between the insert and nozzle components, 52 and 56, respectively. A nozzle face 82 contacts a rotatable disc face 84, and the handle 40 protrudes through the guide opening 42. In some embodiments, such as that disclosed in FIG. 1, the valve is assembled when installed and sealed onto a container. In order to maintain the various components in a proper orientation, a means of matching and securing the components can be included to ensure that the correct openings are aligned. The components of the valve may include cooperatively engaging means such as corresponding grooves and protuberances, so as to properly orient the components when assembling the valve.

Figure 3:
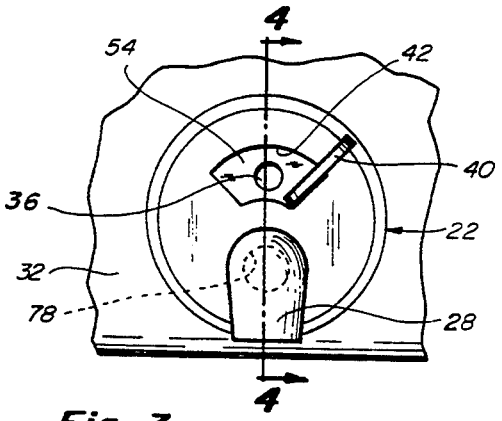
FIG. 3 is a fragmentary front view of the dual orifice valve in the open position and secured to the container of FIG. 1.

FIG. 3 discloses a front view of an embodiment of a previously described dual orifice valve 22 having a movable flow determining handle protuberance 40 positioned in an "open" dispensing position. A dual orifice valve attached to a filled container can simultaneously dispense a beverage contained therein and direct incoming replacement air into a container chamber separate from the beverage containing chamber. The handle protuberance 40 in this embodiment is integral with and operates the rotatable disc portion 54 of the valve 22 so that the orifices 36 and 78 of the rotatable disc 54 align with other openings such as guide 42 and spout 28 to control the beverage and air transfer through the valve 22. In this "open" alignment, beverage can flow through opening 78 and out spout 28 while incoming replacement air can backfill into the appropriate container portion through opening 36. Replacement air does not back diffuse through spout 28 when the beverage is dispensed and the formation of a carbonation depleting head space is prevented. Other embodiments or examples of dual orifice valves are conceivable and useful as long as they include a plurality of openings as a means of simultaneously dispensing beverage and venting replacement air into separate container portions.

The interconnection between a dual orifice valve 22, a container outlet neck 34 and a flexible inner bag portion 30 is disclosed in FIG. 4. The inner bag portion 30 overlaps the tubular portion 66 and is sealed thereto in some manner such as through the use of adhesives or heat bonding or the like. The length of the tubular portion 66, extending significantly inside the container, is sufficient to minimize potential interference between the inner bag-like portion 30 and the beverage exiting the container such as through the spout 28. The rotatable disc 54 has been positioned so as to align the valve openings 68, 36 and 42, as well as the openings 64, 78 and 88. In this "open" orientation, the dispensing beverage will follow the path out of spout 28 as shown by a lower arrow 87, as the replacement air follows the inflating path into the inner bag 30 as indicated by an upper arrow 89. This embodiment of the invention, wherein the replacement air vents into an inflatable bag portion of the container, is preferred as it is the most adaptable to common bottling equipment. One method of incorporating such a container in a commercially used bottling process involves adding an appropriate amount of carbonated beverage to an empty container 20 prior to adding and sealing a dual orifice valve system 22 including an inflatable inner bag portion 30 to the outer wall 34 of the then filled container 20.

Figure 5:
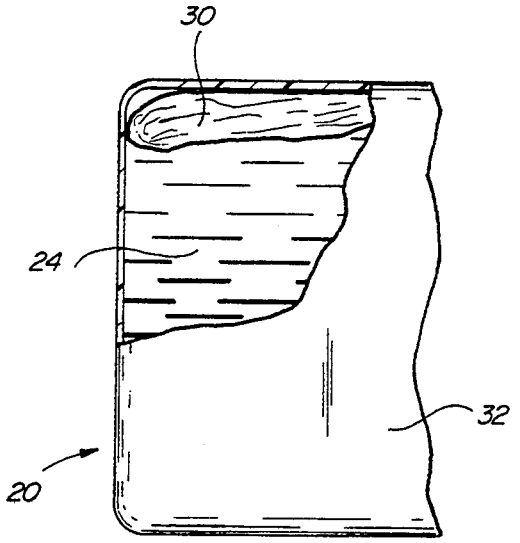
FIG. 5 is a fragmentary cross-sectional view of an embodiment of the present invention.
Figure 6:
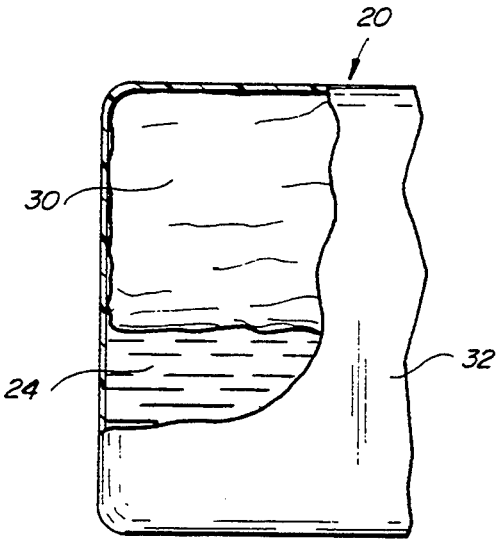
FIG. 6 is fragmentary cross-sectional view of the container of FIG. 5 in a partially full condition.

The cross-sectional views of a container 20 in FIGS. 5 and 6 disclose the function and operation of the flexible inner bag-like portion 30 utilized in this embodiment to separate the carbonated beverage from the replacement air. Specifically, FIG. 5 discloses a portion of a container 20 wherein the carbonated beverage 24 substantially fills the entire container 20. The flexible inner bag portion 30 is attached and sealed air tight to one orifice of the dual orifice valve 22 so that when the beverage 24 is dispensed therefrom and the beverage level decreases, the incoming replacement air simultaneously begins to inflate the initially deflated inner bag 30, as disclosed in FIG. 6. The inner bag 30 can expand to fill the head space void commonly formed in other containers, thereby minimizing undesirable air contact with the beverage. Since there is no carbonation depleting head space formed, the carbon dioxide remains in the beverage for a longer period of time as compared to conventional containers.

Figure 7:
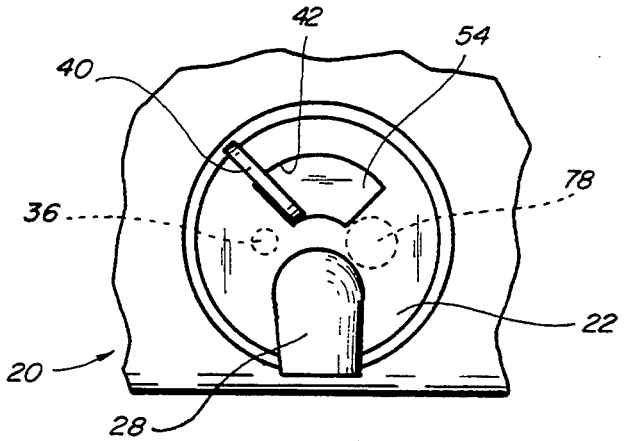
FIG. 7 is a fragmentary front view of the dual orifice valve similar to that shown in FIG. 3 but in the closed position.

The dual orifice valve 22 shown in an open orientation in FIG. 3 is disclosed in a closed, non-dispensing orientation in FIG. 7. The handle protuberance 40 can be moved in the guide opening 42 so that the rotatable disc openings 36 and 78 do not align with the corresponding openings in the insert and nozzle portions of the valve 22. The non-alignment of the openings 36 and 78 thereby prevents beverage from being dispensed and also sealably contains the replacement air in the inner bag portion so as to prevent interaction between the air and the beverage. Although other means of preventing discharge of the beverage can be designed, the disclosed dual orifice valve rotatable disc design is preferred.

Figure 8:
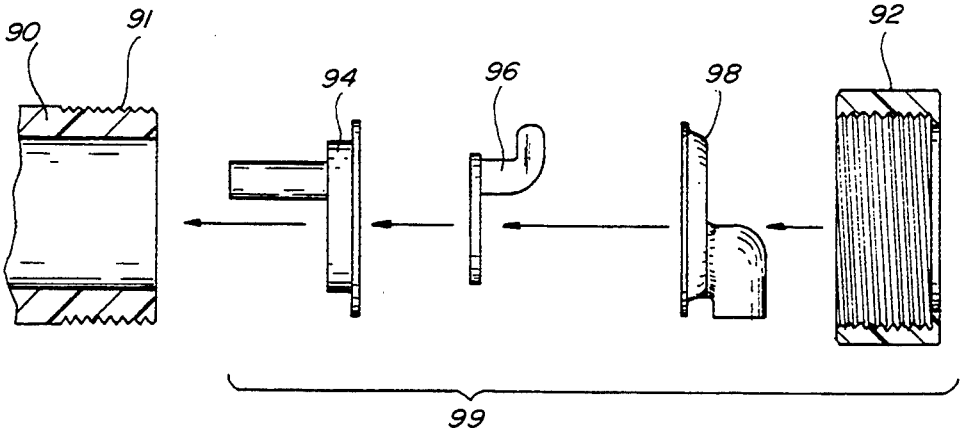
FIG. 8 is an exploded side view of another dual orifice dispensing valve of the present invention.

In FIG. 8, a protruding container neck portion 90 of the present invention can include a threaded portion 91 either on the outside or the inside surface of the neck. The valve 99 likewise can have a threaded portion, such as a threaded collar or valve housing 92, which can fit over the other portions of the valve including the insert 94, the rotatable disc 96 and the nozzle 98. The threaded collar 92 cooperatively mates with the threaded container portion 91 and upon tightening, seals the dual orifice valve 99 with the container neck 90. Alternatively, the nozzle portion 98 of the dual orifice valve 99 may be altered so as to contain threaded side portions in a cap-like manner to interact with corresponding threaded portion 91 of the neck 90.

Figure 9:
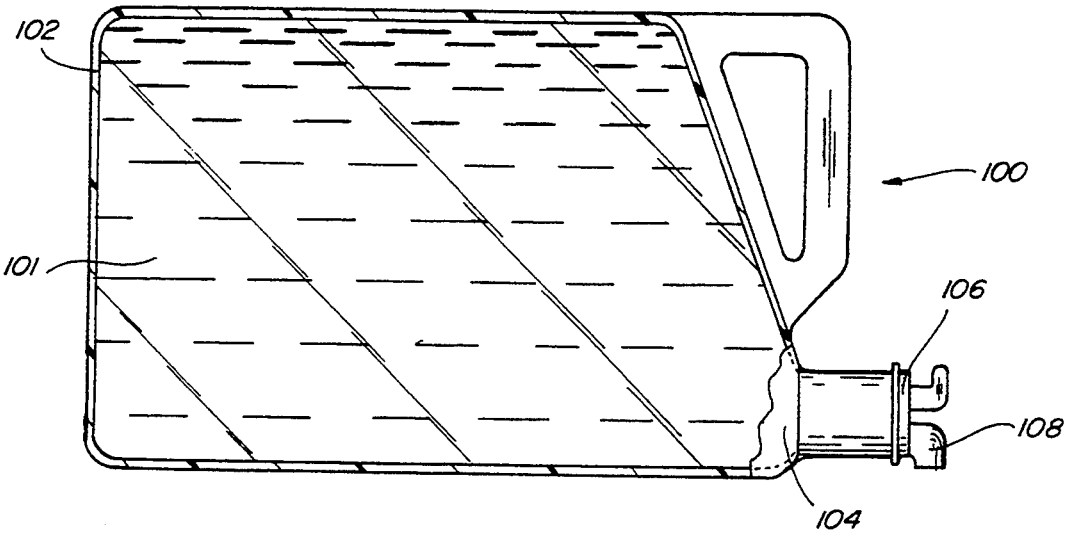
FIG. 9 is a cross-sectional view of another embodiment of the subject container.
Figure 10:
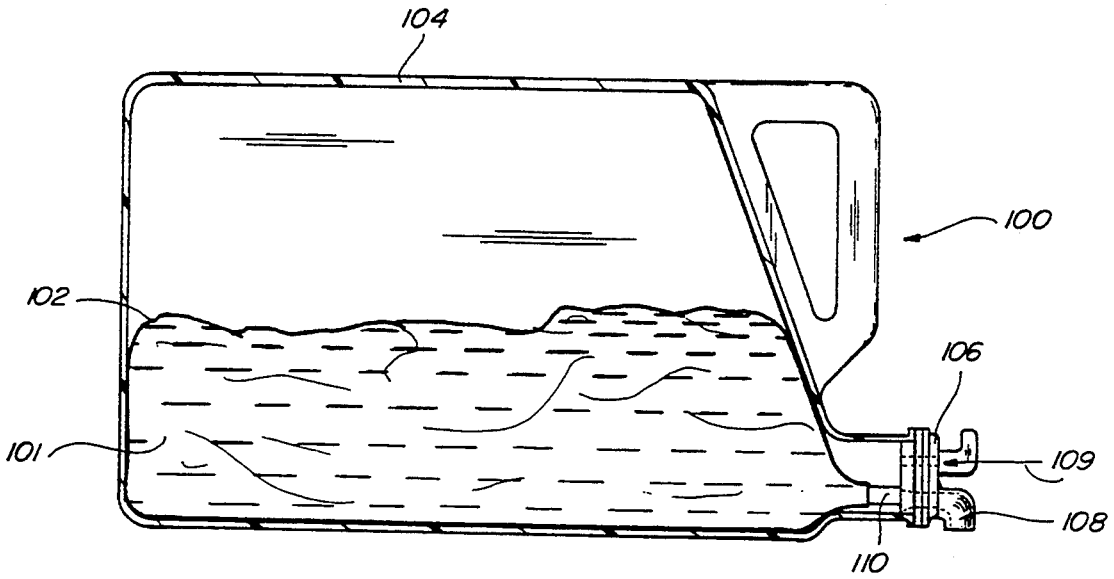
FIG. 10 is another cross-sectional view of the embodiment of FIG. 9.

Another container embodiment 100 of the present invention is disclosed in FIGS. 9 and 10. In this embodiment, the carbonated beverage 101 is contained in a flexible bag-like inner wall portion 102 so that when initially filled with beverage, the bag substantially fills the container 100. The inner bag 102, although sealed to a tubular valve portion 110, is independent of the outer wall portion 104 and can collapse away from the outer wall 104 as beverage 101 is dispensed therefrom. Importantly, as disclosed in FIG. 1 0, as beverage 101 is dispensed from the bag-like inner portion 102 through tubular portion 110 and spout-like orifice 108 of the dual orifice valve 106, the equalizing incoming replacement air feeds in through the valve's second orifice, as indicated by arrow 109, into a space between the inner bag 102 and outer wall 104. As the beverage 101 is dispensed, the inner bag portion 102 collapses with the decreasing beverage volume and conforms to the shape of the beverage 101 remaining therein. The incoming replacement air fills the remaining container volume, separate from the beverage 101. The collapsing bag 102 thus prevents the formation of a head space into which dissolved carbon dioxide would normally diffuse in more conventional containers. In a method for filling containers of the present embodiment, the valve 106 including the inner bag 102 portion is first installed in and sealed from the outer wall 104. The beverage 101 is introduced through the spout 108 when the valve 106 is in its open position.

The embodiment disclosed in FIG. 1 is no more preferable than the embodiment disclosed in FIGS. 9–10. The important structural element is the presence of a flexible barrier between the liquid contained therein and the incoming replacement air as the liquid is dispensed therefrom.

The material or film used in forming a flexible inner bag portion of the present invention can vary appreciably depending on the intended application. When the carbonated beverage is contained in the inner bag portion, as shown in FIGS. 9 and 10, the thickness of the material affects the collapsing rate of the bag which in turn affects the beverage dispensing rate. The thicker the film the slower it collapses and this reduces the dispensing rate. The bag however must be sufficiently thick to retain the weight of the beverage and withstand the outward pressure of the carbonation contained therewithin which sometimes can approach if not exceed about sixty pounds per square inch. The bag-like inner portions can be formed of a relatively thin plastic or polymeric material of sufficient strength to withstand the pressure exerted on it from the carbonated beverage. Polyethylene film is an example of a suitable recyclable polymeric material for the inner bag-like portion. Possible film thicknesses will vary with the properties of the individual materials used, but suitable thicknesses for polyethylene films can vary from about four mils to about ten mils.

Figure 11:
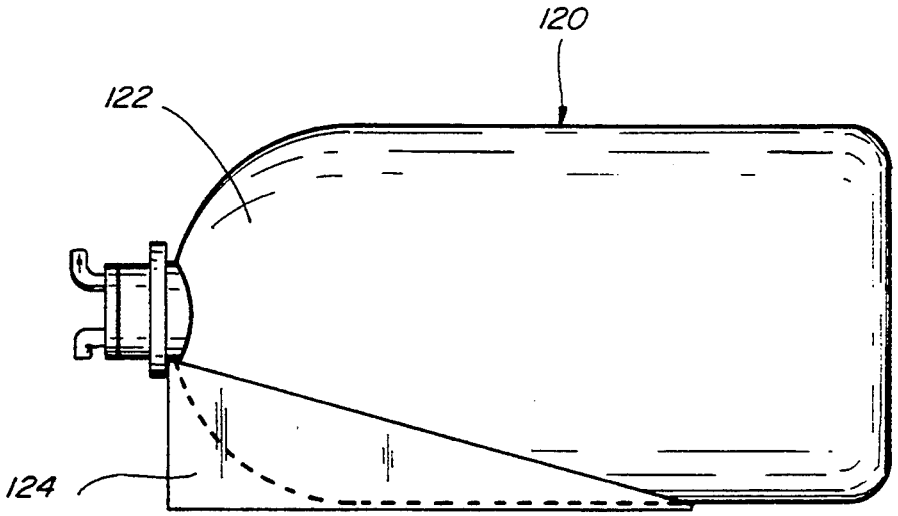
FIG. 11 is a perspective view of another embodiment of the present invention.
Figure 12:
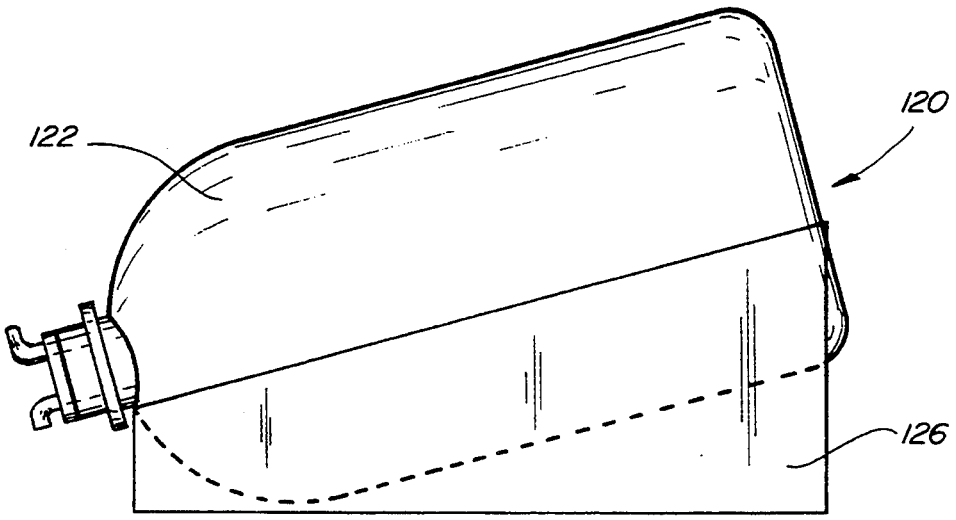
FIG. 12 is a perspective view of yet another embodiment of the present invention.

Yet another embodiment of the present invention is disclosed in FIGS. 11 and 12. A container 120 having a rounder, more cylindrical bottle-shaped outer wall 122 has certain advantages including cost of production and stability when compared to a more rectangular shaped container as disclosed in FIG. 1. As shown in FIG. 11, a stand 124 also can be included to cooperatively abut and assist in retaining the container in a level orientation favorable for the dispensing of the beverage contained therein. A stand 126, as shown in FIG. 12, can be included to retain the container at an angle to aid in the dispensing the beverage.

In the embodiment shown in FIG. 1, where the inner bag portion inflates with the entrance of replacement air, a thinner material may be used. In addition, the materials used in constructing the inner bag portion, as well as the outer portion for that matter, should be stable to the conditions normally associated with such carbonated beverages, including acidic pH's and a range of storage temperatures.

In either embodiment, the rigid outer wall of the container can be formed of a plastic or polymeric material of sufficient strength as to give the container its shape, protect the container from accidental puncturing and withstand the pressures exerted on it from the carbonated beverage contained within. Polyethylene is an example of a suitable material. Additional materials are suitable, especially for the embodiment where the beverage is contained in an inner bag-like portion. Possible outer wall thicknesses will vary with the properties of the individual materials used, but suitable thicknesses for polyethylene films can range from about five mils to about fifty mils.

Although the present invention is specifically directed to the conditions commonly associated with carbonated beverage containers, such as for soft drinks and carbonated waters, it is recognized that the present invention can be adapted for use with other types of carbonated liquids, such as carbonated alcoholic beverages and the like.

Thus, there has been shown and described a novel container device which fulfills all of the objects and advantages sought therefor. Many changes, modifications, variations and other uses and applications of the present invention will, however, become apparent to those skilled in the art after considering this specification and the accompanying drawings. All such changes, modifications, variations and other uses and applications which do not depart from the spirit and scope of the invention are deemed to be covered by the invention which is limited only by the claims which follow.

What is claimed is:

1. A container and valve means thereon from which liquid substances can be dispensed comprising, inner and outer chamber wall portions, one within the other, the liquid substance being positioned within one of the chamber wall portions only, valve means having a first port communicating with one chamber portion and a second port communicating with the other chamber portion, the outer chamber wall portion having a bottom wall for supporting the container in an upstanding position, an outlet port in the outer chamber wall portion extending outwardly therefrom with one side of the outlet port being approximately in the plane of the bottom wall, and an operator member rotatably positioned in the outlet port having opposite ends and a pair of spaced passages therethrough extending between the opposite ends, means communicating the end of one of said spaced passages with the inner chamber wall portion and other means communicating the corresponding end of the other of the spaced passages with the outer chamber wall portion, a wall member closing the end of the outlet port, said wall member being positioned in surface-to-surface contact with the end of the operator member opposite from the connections between the spaced passages and the inner and outer chamber wall portions, a pair of spaced openings through the wall member, said operator member being moveable in the outlet port between an open position wherein one end of each of the spaced passages is aligned with respective openings in the wall member and a closed position wherein the spaced passages through the operator member are closed by engagement with the wall member.

2. The container and valve means of claim 1 wherein the outer chamber wall portion is formed of a material that is more rigid than the material from which the inner chamber wall portion is formed.

3. The container and valve means of claim 1 wherein the liquid substance is positioned within the outer chamber wall portion.

4. The container and valve means of claim 1 wherein the liquid substance is positioned within the inner chamber wall portion.

5. The container and valve means of claim 1 wherein the liquid substance is a carbonated beverage.

6. In a container having separate chamber portions, one within the other, and means forming separate passageways to the respective separate chamber portions, the improvement comprising valve means having separate ports for communicating respectively with the passages to the separate chamber portions, said valve means having an operator member rotatably positioned in one of said separate ports, a wall member closing the end of the one port, said wall member having first, second, and third openings therethrough, the operator member having spaced passages therethrough extending to adjacent to the wall member and movable between a first position establishing communication through the valve means between the respective first and second openings and the spaced passages and a second position wherein the wall member simultaneously closes the spaced passages, said operator member having a flange portion extending into the third opening to limit movement of the operator member in the outlet port between the first and second positions.

7. A container and valve means thereon from which beverages can be dispensed comprising:

the container having an inner chamber formed by a relatively flexible wall and an outer chamber formed by a less flexible wall, the inner chamber wall being located within the outer chamber wall forming separate chamber portions, the beverage positioned within one of the chamber portions only, a bottom wall on the outer chamber wall for supporting the container in an upstanding position, an outlet port in the outer chamber wall one side of which extends outwardly therefrom in the plane of the bottom wall, the valve means including a valve operator member rotatably mounted in the outlet port having opposite ends and a pair of spaced passageways extending between said opposite ends, a wall member closing the outlet port in surface-to-surface contact with one end of the valve operator member, said wall member having three spaced openings therethrough, a projection on said operator member extending through one of said three spaced openings and movable therein between first and second positions abutting opposite sides of said one spaced opening, the other spaced openings in the wall member registering respectively with the adjacent ends of the passageways through the operator member when the operator member is in the first position, the wall member closing the ends of the passageways when the operator member is in the second position, and means separately communicating the opposite ends of said passageways with the spaces defined within the inner and outer chamber portions.

* * * * *